US006109901A

United States Patent [19]

Nakamura et al.

[11] Patent Number: 6,109,901

[45] Date of Patent: Aug. 29, 2000

[54] VANE-TYPE ROTARY COMPRESSOR HAVING A BYPASS PASSAGE DEFINED IN A FRONT COVER

[75] Inventors: Naoki Nakamura, Moriyama; Nobuo Kagoroku, Otsu; Takahiro Hasegaki, Kusatsu; Kenji Watanabe, Moriyama, all of Japan

[73] Assignee: Matsushita Electric Industrial Co., Ltd., Kadoma, Japan

[21] Appl. No.: 09/060,333

[22] Filed: Apr. 15, 1998

[30] Foreign Application Priority Data

Apr. 16, 1997 [JP] Japan ..... 9-098821

[51] Int. Cl.[7] ..... F01C 21/04

[52] U.S. Cl. ..... 418/104; 418/102

[58] Field of Search ..... 418/102, 104

[56] References Cited

U.S. PATENT DOCUMENTS 2,998,783 9/1961 Lee ..... 418/102
4,171,938 10/1979 Pahl ..... 418/102 X
4,199,305 4/1980 Pareja ..... 418/102 X
4,770,616 9/1988 Kahrs ..... 418/102 X
5,083,909 1/1992 Kunsemiller et al. ..... 418/102

FOREIGN PATENT DOCUMENTS 208585 8/1989 Japan ..... 418/102

*Primary Examiner*—Hoang Nguyen
*Attorney, Agent, or Firm*—Wenderoth, Lind & Ponack, L.L.P.

[57] ABSTRACT

A vane-type rotary compressor has a compression chamber delimited by a cylinder and front and rear covers secured to opposite ends of the cylinder. The front cover accommodates main and auxiliary shaft seal parts held in contact with a drive shaft. A space defined between the two shaft seal parts communicates with a suction stroke portion of the compression chamber via at least one bypass passage. Accordingly, the pressure and temperature acting on the main shaft seal part are substantially the same as those acting on the suction stroke portion, thus reducing the pressure and temperature on the main shaft seal part.

4 Claims, 4 Drawing Sheets

VANE-TYPE ROTARY COMPRESSOR HAVING A BYPASS PASSAGE DEFINED IN A FRONT COVER

BACKGROUND OF THE INVENTION

1. Field of the Invention

The present invention relates generally to a vane-type rotary compressor for use in, for example, an automotive air conditioner and, in particular but not exclusively, to an improvement of shaft seal parts mounted in a vane-type rotary compressor.

2. Description of Related Art

FIG. 1 depicts a conventional vane-type rotary compressor that includes a cylinder 1 having a cylindrical inner surface, a rotor 4 rotatably mounted in the cylinder 1, and front and rear covers 7, 8 secured to opposite ends of the cylinder 1, respectively, to define a compression chamber 9 therebetween. The front cover 7 accommodates only one shaft seal part 13 and has a bypass passage 16 defined therein so as to extend therethrough. The bypass passage 16 opens at one end thereof to a space defined between a bearing 11 and the shaft seal part 13 and at the other end thereof to a minute space defined between the rotor 4 and the front cover 7 at a suction stroke portion of the compression chamber 9.

In the above-described construction, because the bypass passage 16 opens to the suction stroke portion, a refrigerant containing a lubricant passes a space between the bearing 11 and a drive shaft 10 and is led to the shaft seal part 13 and then to the suction stroke portion via the bypass passage 16, supplying the bearing 11 and the shaft seal part 13 with the lubricant.

In this construction, however, it is impossible to prevent the shaft seal part 13 from communicating with a compression stroke portion of the compression chamber 9. Accordingly, a pressure substantially equal to the discharge pressure acts on the shaft seal part 13, increasing the temperature and pressure around the shaft seal part 13. To ensure the reliability of component parts of the shaft seal part, a relatively complicated construction is required.

SUMMARY OF THE INVENTION

The present invention has been developed to overcome the above-described disadvantages.

It is accordingly an objective of the present invention to provide an improved vane-type rotary compressor capable of reducing the pressure and temperature acting on a shaft seal part.

In accomplishing the above and other objectives, the vane-type rotary compressor according to the present invention includes a cylinder having a cylindrical inner surface, a rotor rotatably mounted in the cylinder and having a plurality of slots defined therein, a plurality of vanes slidably mounted in the plurality of slots, respectively, a drive shaft to which the rotor is rigidly secured for rotation together therewith, first and second covers secured to opposite ends of the cylinder to define a compression chamber therebetween, and a bearing mounted in the first cover for rotatably supporting the drive shaft. The first cover has a first bypass passage defined therein so as to extend therethrough. The vane-type rotary compressor also includes a first shaft seal part mounted in the first cover so as to be held in contact with the drive shaft and a second shaft seal part mounted in the first cover so as to be held in contact with the drive shaft and positioned between the bearing and the first shaft seal part, a space, defined between the first and second shaft seal parts, communicates with a suction stroke portion of the compression chamber via the first bypass passage.

In this construction, because the second shaft seal part prevents the first shaft seal part from communicating with a compression stroke portion of the compression chamber, and because the space between the first and second shaft seal parts communicates with the suction stroke portion, a high-pressure and high-temperature refrigerant generated in the compression stroke portion is not drawn into such a space. Accordingly, the pressure and temperature acting on the first shaft seal part are substantially equal to those acting on the suction stroke portion, thus reducing pressure- and temperature-loads on the first shaft seal part and making it possible to simplify the construction of the first shaft seal part.

Advantageously, the first cover also has at least one second bypass passage defined therein so as to extend therethrough. The first and second bypass passages open to the suction stroke portion of the compression chamber.

Where an opening of the first bypass passage is positioned closer to a suction port than that of the second bypass passage, after the vanes have passed through the opening of the first bypass passage and before they reach the opening of the second bypass passage, the pressure within the second bypass passage becomes slightly higher than that within the first bypass passage, thereby making the refrigerant flow from the second bypass passage to the space between the first and second shaft seal parts and then to the first bypass passage. Accordingly, a lubricant together with the refrigerant is supplied into the space between the first and second shaft seal parts, thereby effectively lubricating such parts and enhancing the reliability of the compressor.

Again advantageously, the first and second bypass passages open to both the suction stroke portion of the compression chamber and a space defined between the rotor and the first cover.

By so doing, the total area of those portions of the openings that open to the suction stroke portion is reduced, making it possible to reduce the amount of the refrigerant that circulates the suction stroke portion, the second bypass passage, the space between the first and second shaft seal parts, and the first bypass passage in this order before the refrigerant returns back to the suction stroke portion. As a result, a reduction in compression efficiency can be avoided.

BRIEF DESCRIPTION OF THE DRAWINGS

The above and other objectives and features of the present invention will become more apparent from the following description of a preferred embodiment thereof with reference to the accompanying drawings, throughout which like parts are designated by like reference numerals, and wherein.

DETAILED DESCRIPTION OF THE PREFERRED EMBODIMENTS

This application is based on application No. 9-98821 filed Apr. 16, 1997 in Japan, the content of which is incorporated hereinto by reference.

Figure 1:
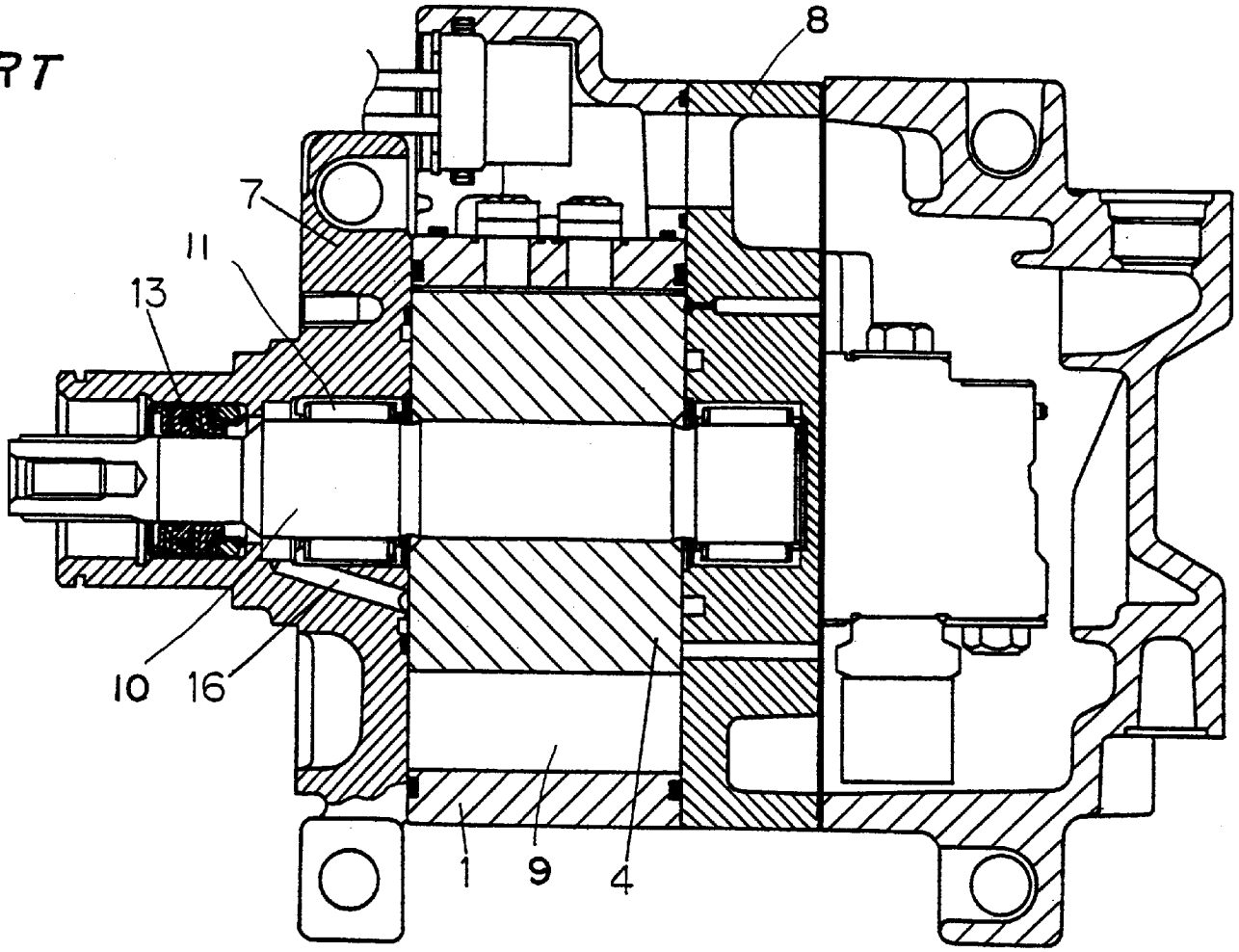
Fig. 1 PRIOR ART
FIG. 1 is a vertical sectional view of a conventional vane-type rotary compressor (already referred to)
Figure 2:
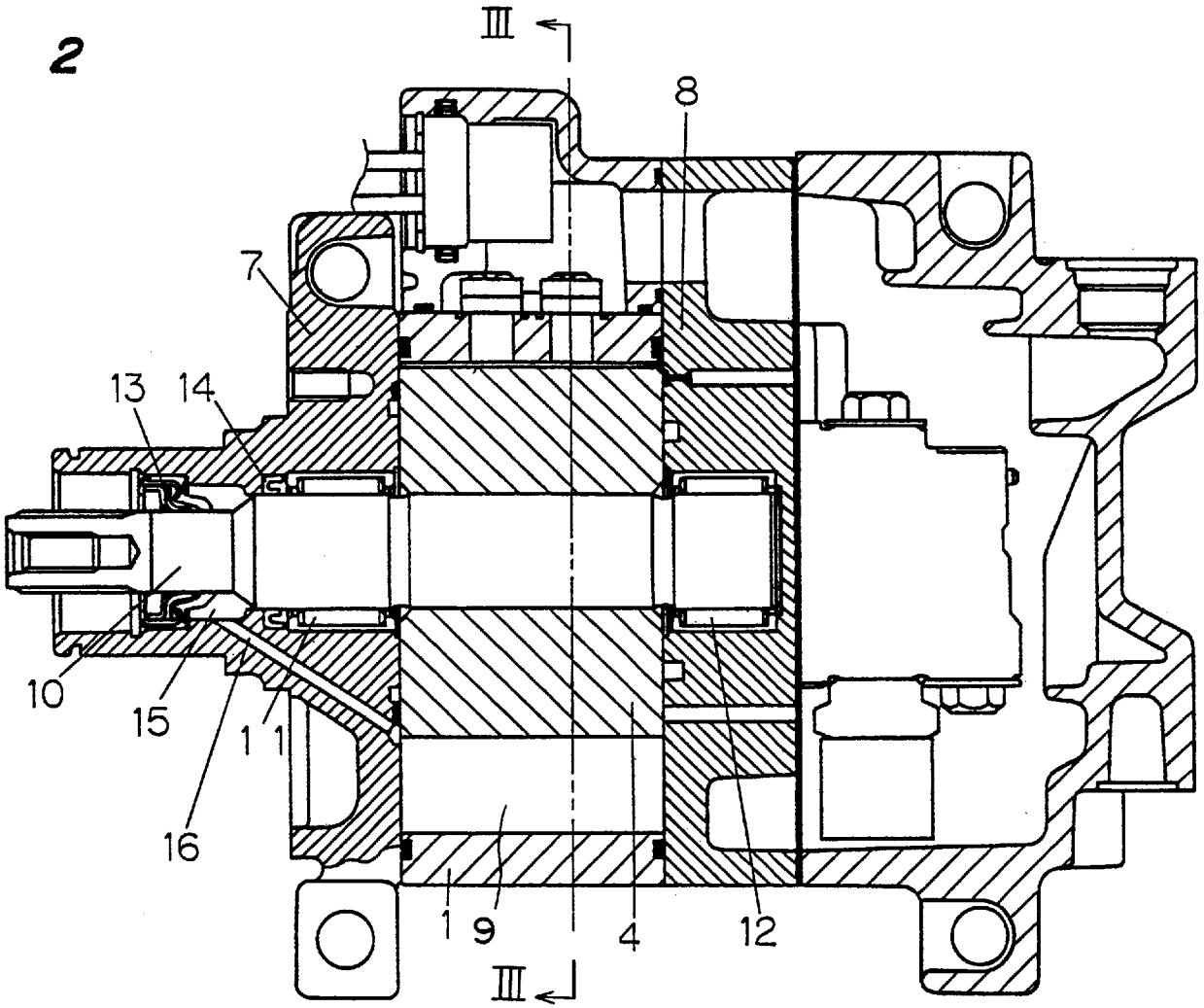
FIG. 2 is a vertical sectional view of a vane-type rotary compressor according to a first embodiment of the present invention.
Figure 3:
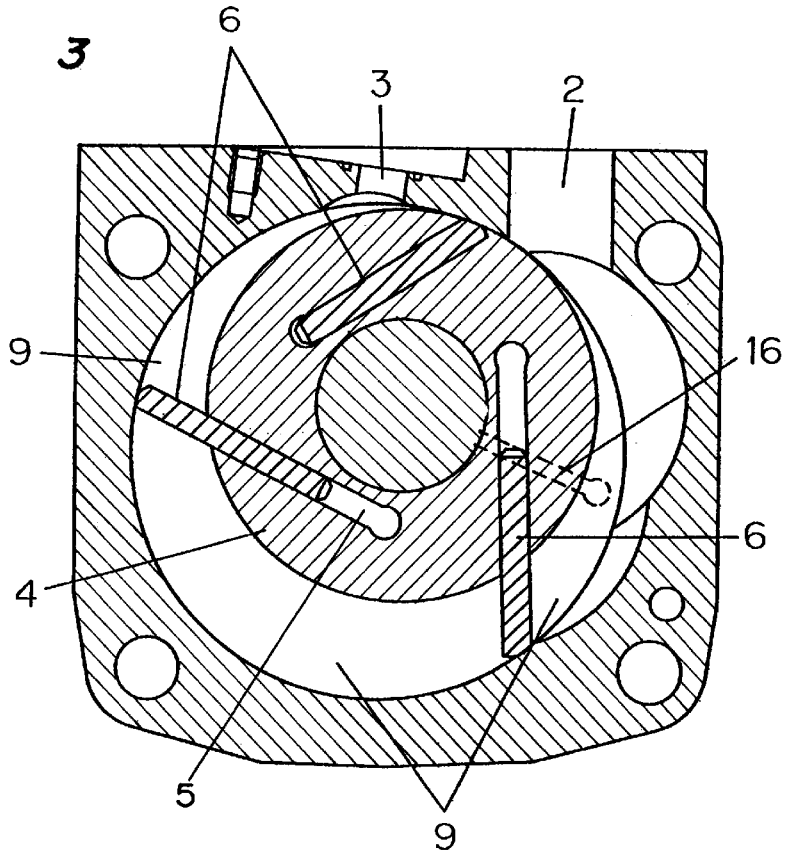
FIG. 3 is a vertical sectional view taken along line III—III in FIG. 2.

Referring now to the drawings, there is shown in FIGS. 2 and 3 a vane-type rotary compressor according to a first embodiment of the present invention.

As shown in FIGS. 2 and 3, the rotary compressor includes a cylinder 1 that has a cylindrical inner surface, a suction port 2 defined therein and a discharge port 3 defined therein. The rotary compressor also includes a rotor 4 rotatably mounted in the cylinder 1 and having a plurality of slots 5 defined therein in each of which a vane 6 is slidably mounted. The cylinder 1 is secured at opposite ends thereof to a front cover or plate 7 and a rear cover or plate 8 so that a compression chamber 9 is delimited by the cylinder 1, rotor 4, front cover 7 and rear cover 8. The rotor 4 is rigidly secured to a drive shaft 10 for rotation together therewith, which is journaled in a front bearing 11 mounted in the front cover 7 and in a rear bearing 12 mounted in the rear cover 8. The front cover 7 accommodates a main shaft seal part 13 secured thereto in the proximity of a front end thereof and an auxiliary shaft seal part 14 secured thereto in the proximity of the front bearing 11. Both the main and auxiliary shaft seal parts 13, 14 are held in contact with the drive shaft 10. The front cover 7 has a bypass passage 16 defined therein so as to extend therethrough to make a suction stroke portion of the compression chamber 9 communicate with a space 15 defined between the main and auxiliary shaft seal parts 13, 14.

In the above-described construction, because the auxiliary shaft seal part 14 prevents the main shaft seal part 13 from communicating with a compression stroke portion of the compression chamber 9, and because the space 15 between the main and auxiliary shaft seal parts 13, 14 communicates with the suction stroke portion of the compression chamber 9, a high-pressure and high-temperature refrigerant generated in the compression stroke portion is not drawn into the space 15, and the pressure and temperature acting on the main shaft seal part 13 are substantially the same as those acting on the suction stroke portion, thus reducing pressure- and temperature-loads on the main shaft seal part 13.

Figure 4:
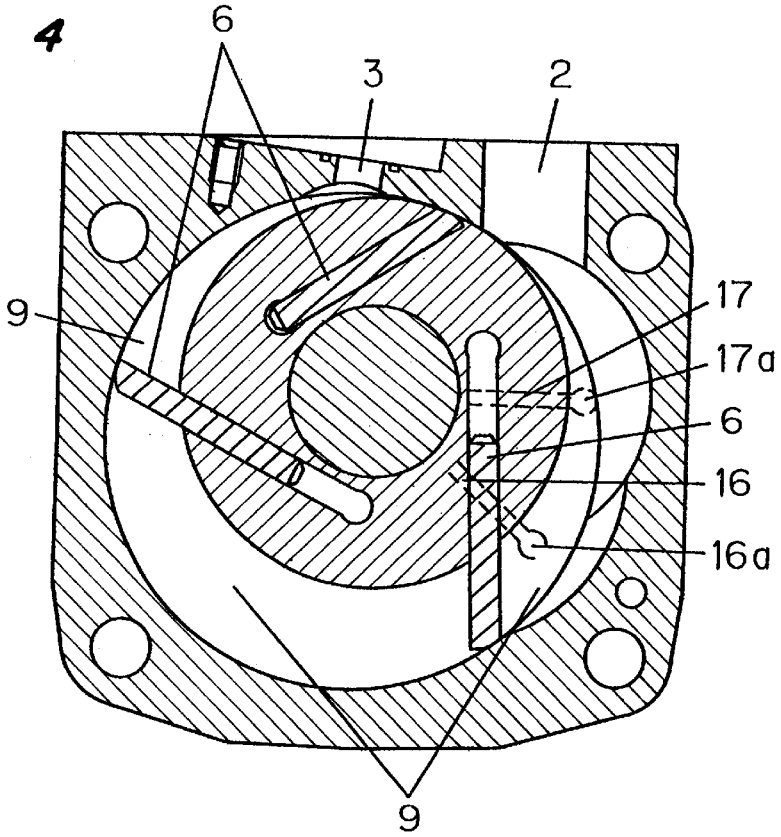
FIG. 4 is a view similar to FIG. 3, but according to a second embodiment of the present invention.

FIG. 4 depicts a vane-type rotary compressor according to a second embodiment of the present invention, wherein the front cover 7 has two bypass passages 16, 17 defined therein so as to extend therethrough to make the suction stroke portion of the compression chamber 9 communicate with the space 15 defined between the main and auxiliary shaft seal parts 13, 14. Both the two bypass passages 16, 17 open to the suction stroke portion of the compression chamber 9, and one 17 of them is positioned in the proximity of a location where the suction stroke begins, while the other 16 is positioned at a location immediately before completion of the suction stroke.

This construction provides the same effects as in the first embodiment of the present invention. Furthermore, after the vanes 6 have passed through an opening 17*a* of the bypass passage 17 and before they reach an opening 16*a* of the bypass passage 16, the pressure within the bypass passage 16 becomes slightly higher than that within the bypass passage 17, making the refrigerant flow from the bypass passage 16 to the space 15 between the main and auxiliary shaft seal parts 13, 14 and then to the bypass passage 17. Accordingly, a lubricant together with the refrigerant is supplied into the space 15 between the main and auxiliary shaft seal parts 13, 14, thereby effectively lubricating such parts.

Figure 5:
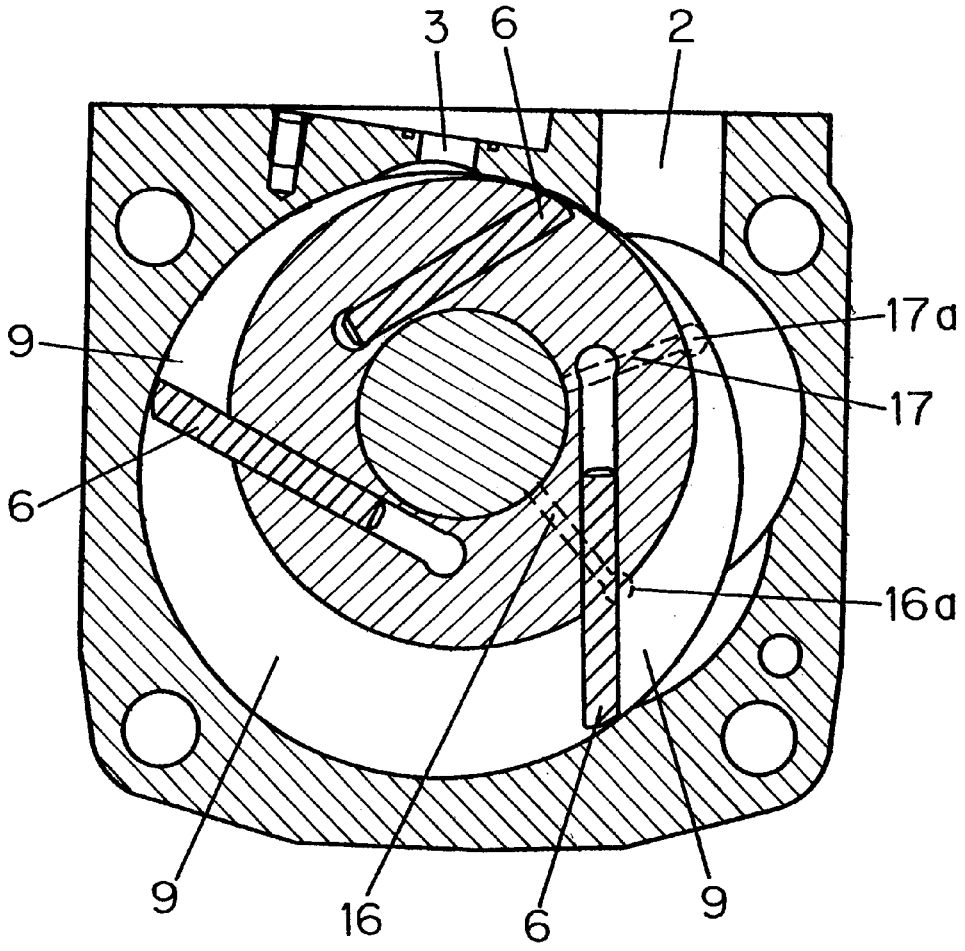
FIG. 5 is a view similar to FIG. 3, but according to a third embodiment of the present invention.

FIG. 5 depicts a vane-type rotary compressor according to a third embodiment of the present invention, which has two bypass passages 16, 17 defined therein so as to extend therethrough to make the suction stroke portion of compression chamber 9 communicate with the space 15 defined between the main and auxiliary shaft seal parts 13, 14. The rotary compressor of FIG. 5, however, differs from that of FIG. 4 in that the two bypass passages 16, 17 shown in FIG. 5 open at 16*a* and 17*a* to both the suction stroke portion of the compression chamber 9 and a minute space defined between the rotor 4 and the front cover 7. By so doing, the total area of those portions of the openings 16*a*, 17*a* that open to the suction stroke portion is reduced, making it possible to reduce the amount of the refrigerant that circulates the suction stroke portion, the bypass passage 16, the space 15 between the main and auxiliary shaft seal parts 13, 14, and the bypass passage 17 in this order before the refrigerant returns back to the suction stroke portion. As a result, a reduction in compression efficiency which has been hitherto caused by lubricant circulation during the suction stroke can be avoided.

It is to be noted here that although in the above-described embodiments the front cover 7 has been described as having one or two bypass passages, it may have three or more bypass passages that open to the suction stroke portion of the compression chamber 9.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A vane-type rotary compressor comprising:

a cylinder having a cylindrical inner surface;

a rotor rotatably mounted in said cylinder and having a plurality of slots defined therein;

a plurality of vanes slidably mounted in said plurality of slots, respectively;

a drive shaft to which said rotor is rigidly secured for rotation together therewith;

first and second covers secured to opposite ends of said cylinder to define a compression chamber therebetween, said first cover having a first bypass passage defined therein so as to extend therethrough;

a bearing mounted in said first cover for rotatably supporting said drive shaft;

a first shaft seal part mounted in said first cover so as to be held in contact with said drive shaft; and a second shaft seal part mounted in said first cover and positioned between said bearing and said first shaft seal part, said second shaft seal part being held in contact with said drive shaft, wherein a space defined between said first and second shaft seal parts communicates with a suction stroke portion of said compression chamber via said first bypass passage.

2. The vane-type rotary compressor according to claim 1, wherein said first cover has at least one second bypass passage defined therein so as to extend therethrough, said first bypass passage and said at least one second bypass passage being open to the suction stroke portion of said compression chamber.

3. The vane-type rotary compressor according to claim 1, wherein said first bypass passage opens to both the suction stroke portion of said compression chamber and a space defined between said rotor and said first cover.

4. The vane-type rotary compressor according to claim 2, wherein said first bypass passage and said at least one second bypass passage open to both the suction stroke portion of said compression chamber and a space defined between said rotor and said first cover.

* * * * *